US011642000B2

(12) United States Patent
Karazor

(10) Patent No.: US 11,642,000 B2
(45) Date of Patent: May 9, 2023

(54) DISHWASHING MACHINE AND METHOD

(71) Applicant: Vestel Elektronik Sanayi ve Ticaret A.S., Manisa (TR)

(72) Inventor: Irfan Karazor, Manisa (TR)

(73) Assignee: VESTEL ELEKTRONIK SANAYI VE TICARET A.S., Manisa (TR)

( * ) Notice: Subject to any disclaimer, the term of this patent is extended or adjusted under 35 U.S.C. 154(b) by 6 days.

(21) Appl. No.: 17/272,240

(22) PCT Filed: Aug. 29, 2018

(86) PCT No.: PCT/EP2018/073266

§ 371 (c)(1),
(2) Date: Feb. 26, 2021

(87) PCT Pub. No.: WO2020/043285

PCT Pub. Date: Mar. 5, 2020

(65) Prior Publication Data

US 2021/0177236 A1 Jun. 17, 2021

(51) Int. Cl.

| | |
|---|---|
| ***A47L 15/23*** | (2006.01) |
| ***A47L 15/00*** | (2006.01) |
| ***A47L 15/42*** | (2006.01) |

(52) U.S. Cl.

CPC ..... *A47L 15/23* (2013.01); *A47L 15/0049* (2013.01); *A47L 15/4282* (2013.01);
(Continued)

(58) Field of Classification Search

None

See application file for complete search history.

(56) References Cited

U.S. PATENT DOCUMENTS

2006/0219262 A1* 10/2006 Peterson ..... A47L 15/4244 134/25.2
2007/0017551 A1* 1/2007 Hartogh ..... A47L 15/0023 134/25.2

(Continued)

FOREIGN PATENT DOCUMENTS

| | | |
|---|---|---|
| CH | 694495 | 2/2005 |
| DE | 4418558 A1 | 11/1995 |

(Continued)

OTHER PUBLICATIONS

Notice of Reasons for Rejection of Japanese Patent Application No. JP 2021-510987 dated Aug. 2, 2022 (3 pages).

*Primary Examiner* — Mikhail Kornakov
*Assistant Examiner* — Ryan L Coleman
(74) *Attorney, Agent, or Firm* — J. Miguel Hernandez; James R. Gourley; Carstens, Allen & Gourley, LLP

(57) ABSTRACT

Dishwashing machine comprising: a controller; a spray arm assembly comprising a spray arm having one or more spray holes for spraying a washing load with water, and a pipe for delivering water to the spray arm; a pump for pumping water through the pipe and to the spray arm; the pipe being constructed and arranged to at least partially restrict flow of water from the pump to at least a part of the spray arm dependent on spray arm orientation relative to the pipe, a power consumption of the pump thereby being dependent at least in part on the spray arm orientation relative to the pipe; and the controller being configured to monitor the power consumption of the pump in order to determine rotational information of the spray arm.

13 Claims, 10 Drawing Sheets

(52) U.S. Cl.
CPC ..... *A47L 2401/08* (2013.01); *A47L 2401/20* (2013.01); *A47L 2401/24* (2013.01); *A47L 2401/26* (2013.01); *A47L 2501/26* (2013.01); *A47L 2501/28* (2013.01); *A47L 2501/32* (2013.01)

(56) References Cited

U.S. PATENT DOCUMENTS

| | | | | |
|---|---|---|---|---|
| 2014/0230856 | A1 | 8/2014 | Sundaram | |
| 2015/0359405 | A1 | 12/2015 | Kim et al. | |
| 2018/0199789 | A1* | 7/2018 | Thiyagarajan | A47L 15/23 |

FOREIGN PATENT DOCUMENTS

| | | | |
|---|---|---|---|
| DE | 102010027756 | A1 | 10/2011 |
| DE | 102010028557 | A1 | 11/2011 |
| EP | 1778068 | B1 | 8/2009 |
| EP | 2954829 | A1 | 12/2015 |
| JP | 63160629 | A | 7/1988 |
| JP | 7313434 | A | 5/1995 |
| JP | 20114864 | A | 1/2011 |
| WO | 2011132356 | A1 | 10/2011 |
| WO | 2016096019 | A1 | 6/2016 |

* cited by examiner

DISHWASHING MACHINE AND METHOD

CROSS REFERENCE TO A RELATED APPLICATION

This application is a US 371 application from PCT/EP2018/073266 entitled "A DISHWASHING MACHINE AND METHOD" filed on Aug. 29, 2018 and published as Wo 202/043285 A1 on Mar. 5, 2020. The technical disclosures of every application and publication listed in this paragraph are hereby incorporated herein by reference.

TECHNICAL FIELD

The present disclosure relates to a dishwashing machine and a method of controlling a dishwashing machine.

BACKGROUND

Dishwashing machines (also referred to as dishwashers) are used for washing items such as crockery and cutlery. A known dishwashing machine comprises a washing compartment for holding one or more items to be washed, and a washing mechanism for washing those items. Such a washing mechanism typically comprises one or more spray arms. Typically a user can select from a plurality of pre-defined washing cycles via a user interface on a front face of the dishwashing machine

SUMMARY

According to a first aspect disclosed herein, there is provided a dishwashing machine comprising: a controller; a spray arm assembly comprising a spray arm having one or more spray holes for spraying a washing load with water, and a pipe for delivering water to the spray arm; a pump for pumping water through the pipe and to the spray arm; the pipe being constructed and arranged to at least partially restrict flow of water from the pump to at least a part of the spray arm dependent on spray arm orientation relative to the pipe, a power consumption of the pump thereby being dependent at least in part on spray arm orientation relative to the pipe; and the controller being configured to monitor the power consumption of the pump in order to determine rotational information of the spray arm.

By monitoring the cycle of power consumed by the pump, the controller can accurately determine when the spray arm is blocked by an obstruction in the dishwashing machine, such as an incorrectly placed item to be washed. This is because when the spray arm is rotating normally, the power consumption of the pump follows a particular expected cycle. If the power consumption of the pump differs from this cycle then the controller knows that the spray arm is not rotating correctly. This arrangement helps to prevent damage to the spray arm and the water pump since the washing cycle can be stopped if the spray arm is blocked. It also ensures that the quality of cleaning provided by the dishwashing machine is not impacted by the spray arm not rotating correctly.

In an example, the pipe comprises a barrier for at least partially restricting the flow of water to the spray arm.

In an example, the barrier is integrally formed with the pipe.

In an example, the barrier projects upwardly from an end face of the pipe.

In an example, the one or more spray holes are oriented so as to facilitate rotation of the spray arm when water is ejected from the one or more spray holes.

In an example, the spray arm comprises a first side and a second side, and wherein the first side of the spray arm has more spray holes than the second side of the spray arm.

In an example, the controller is configured to determine the rotational information of the spray arm by comparing a determined power consumption of the pump with an expected power consumption of the pump.

In an example, the controller is configured to cause an alert to be output to a user when the determined power consumption of the pump differs from the expected power consumption of the pump by more than a predetermined value.

In an example, the controller is configured to cause an alert to be output to a user when the determined power consumption of the pump differs from the expected power consumption of the pump for longer than a predetermined time period.

According to a second aspect disclosed herein, there is provided a method comprising: monitoring a power consumption of a pump for pumping water to a spray arm assembly of a dishwashing machine, a power consumption of the pump being dependent at least in part on an orientation of the spray arm relative to a pipe that is constructed and arranged to at least partially restrict flow of water from the pump to at least part of the spray arm; and determining rotational information of the spray arm using information from the monitored power consumption of the pump.

In an example, the method comprises determining rotational information of the spray arm by comparing a determined power consumption of the pump with an expected power consumption of the pump.

In an example, the method comprises causing an alert to be output to a user when the determined power consumption of the pump differs from the expected power consumption of the pump by more than a predetermined value.

In an example, the method comprises causing an alert to be output to a user when the determined power consumption of the pump differs from the expected power consumption of the pump for longer than a predetermined time period.

In an example, the method comprises halting a washing cycle of the dishwashing machine when the determined power consumption of the pump differs from the expected power consumption of the pump.

In an example, the method comprises automatically restarting the washing cycle when it is determined that the alert has been cleared.

BRIEF DESCRIPTION OF THE DRAWINGS

To assist understanding of the present disclosure and to show how embodiments may be put into effect, reference is made by way of example to the accompanying drawings in which.

DETAILED DESCRIPTION

The present disclosure has applicability to dishwashing machines (also referred to as dishwashers). Dishwashing machines are used to automate the washing of items associated with food preparation and/or cooking and/or eating. Such items include crockery such as plates, bowls, cups, mugs etc. Such items may also include cutlery such as knives, forks, spoons, or indeed any other cooking or eating utensil. Other items that may be washed include glassware, food containers etc.

Figure 1:
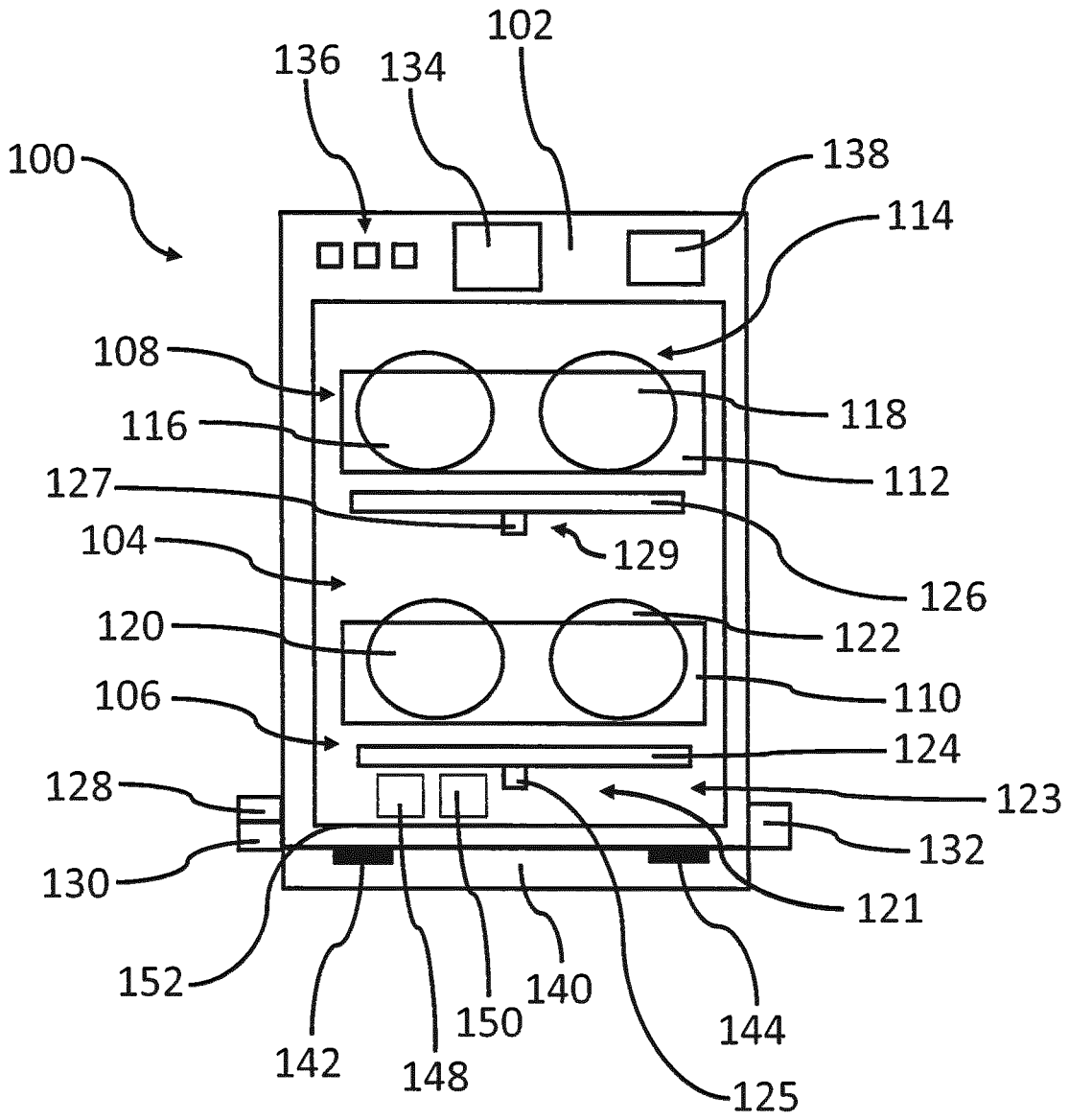
FIG. 1 shows schematically a dishwashing machine according to an example.

FIG. 1 schematically shows an example of a dishwashing machine 100. The dishwashing machine 100 comprises a main body 102, within which there is a washing compartment 104. The washing compartment 104 comprises a lower portion 106 and an upper portion 108. The lower portion 106 comprises a tray or rack 110 for holding items to be washed, and the upper portion 108 comprises a tray or rack 112 for holding items to be washed. The racks 110 and 112 can be moved in and out of the washing compartment 104 on roller assemblies.

Items to be washed are schematically shown at 114. In this case the items to be washed are schematically represented by plates 116 and 118 on rack 112, and plates 120 and 122 on rack 120. Of course there may alternatively be any other type of item to be washed or combination of items to be washed. In the example of FIG. 1 a washing mechanism 123 comprises spray arm 124 in lower portion 106, and spray arm 126 in upper portion 108. In other examples the upper spray arm 126 is omitted. Each spray arm comprises a series of holes or nozzles which can spray water upwardly towards the items to be washed 114, while the spray arms 124 and 126 rotate. These are commonly referred to as spray holes. They may also be referred to as water outlets. Rotation of the spray arms 124 and 126, whilst ejecting water therefrom, helps to clean the items in a washing load.

In the example of FIG. 1 the spray arm 124 is connected to pipe 125. The pipe 125 enables rotation of spray arm 124 about a central axis of the pipe 125. The pipe 125 and spray arm 124 may be considered to be comprised in a spray arm assembly 121. In the example of FIG. 1 the spray arm 126 is connected to pipe 127. The pipe 127 enables rotation of spray arm 126 about a central axis of the pipe 127.

The dishwashing machine 100 further comprises water inlet 128 and water outlet 130 for enabling water to be fed to and taken away from the dishwashing machine respectively. In some examples a heater element (not shown) is provided for heating water as necessary. In other examples hot and cold water is drawn from a building's supply as required. A power connection is schematically shown at 132, which enables the dishwashing machine to be connected to mains electrical power for powering the dishwashing machine.

A water pump is schematically shown at 150. The water pump 150 is constructed and arranged to distribute water around the dishwashing machine 100. For example, the water pump 150 can pump water to spray arms 124 and 126. Water that has been sprayed falls back down to a base or sump 152 of the dishwashing machine 100, from where that water can be recycled (after filtering, in some examples) by the pump 150.

In some examples rotation of the spray arms 124 and 126 is effected by the force of water being ejected from spray holes of the spray arms. In such examples the spray holes may be arranged and/or oriented so as to facilitate such rotation. Additionally or alternatively one or more motors, shown schematically at 148, may be provided for powering rotation of the spray arms 124 and 126.

A controller is schematically shown at 134 for controlling operations of the dishwashing machine. The controller 134 can, for example, cause the dishwashing machine to operate according to one or more pre-determined washing cycles selected via a user interface 136. The available washing cycles may differ from each other by temperature and/or duration, for example. Via the user interface 136 a user may also be able to select whether the washing cycle is for a full or half load. A display 138 is also provided which can display information to the user. This may include information such as confirming a user's washing cycle selection, as well as information such as time remaining of a washing cycle that is in progress.

A door of the dishwashing machine is schematically shown at 140. The door 140 is connected to main body 120 via hinges 142 and 144. In FIG. 1 the door is in an open position enabling access to washing compartment 104. The door 140 may be moved to a closed position so that the washing compartment 104 is then substantially enclosed. The door 140 may also include a receptacle for holding dishwashing detergent (e.g. a dishwashing machine cube) which can be released in to the dishwashing machine during a wash. The receptacle for holding washing detergent may of course also be positioned elsewhere within the dishwashing machine. The dishwashing machine may also include one or more further receptacles for containing dishwashing machine salt and/or rinse aid, for example.

A washing cycle of a dishwashing machine 100 includes three basic phases. First, the items to be washed 114 are wetted by the washing mechanism 123. Next, the items to be washed 114 are cleaned by the washing mechanism 123 spraying them with a mixture of hot water and a dishwashing detergent. Finally, the items to be washed 114 are rinsed with clean water and then air dried by the residual heat in the dishwashing machine or dried by a fan circulating hot air around the washing compartment 104.

The present inventor has realised that occasionally during a washing cycle one or both of the spray arms 124, 126 stop rotating. For example, a spray arm 124, 126 may come into contact with an item to be washed 114, which impedes spray arm rotation. This can result in inadequate cleaning of the items to be washed 114 because the water sprayed by the impeded spray arm cannot reach all of the items to be washed 114.

FIGS. 2 to 5 show a spray arm assembly 221 fluidly connected to a pump 254. The spray arm assembly 221 includes a spray arm 224 mounted on a pipe 225. The pipe 225 fluidly connects the spray arm assembly 221 to the pump 254 so that the pump 254 can deliver water to the spray arm 224. The spray arm 224 is mounted to the pipe 225 so that the spray arm 224 can rotate about the pipe 225. In examples the pipe 225 remains static or fixed while the spray arm 224 rotates about the pipe 225. To this end the pipe 225 may be considered a stator, and the spray arm 224 may be considered a rotor. A suitable bearing assembly may be provided between the spray arm 224 and the pipe 225 to facilitate the relative rotation. In the example shown in FIGS. 2 to 5, the spray arm 224 rotates in a clockwise direction when viewed in plan. In other examples the spray arm 224 may rotate in an anticlockwise direction.

The spray arm 224 includes a plurality of spray holes 256. In this example, each spray hole 256 comprises an aperture. A liquid such as water can be ejected out of each spray hole 256. The pump 254 can pump water through the pipe 225, into the spray arm 224, and out of the spray holes 254 to clean any items to be washed 214.

In in this example, rotation of the spray arm 224 is effected by the force of water being ejected from the spray holes 256. One or more of the plurality of spray holes 256 may be oriented so as to facilitate such rotation.

The pipe 225 includes a barrier portion 258. The barrier 258 is constructed and arranged to at least partially restrict the flow of water from the pump 254 to a part of the spray arm 224 when the spray arm 224 is in one or more certain orientations as it rotates relative to the pipe 225. This decreases the flow of water to that part of the spray arm 224 relative to the other part of the spray arm 224. In this example, the barrier 258 is a separate piece that is attached to an end of the pipe 225. In another example, the barrier 258 may be integrally formed with the pipe 225. In one example, the barrier 258 is also constructed and arranged to direct the flow of water from the pump 254 to a part of the spray arm 224 when the spray arm 224 is in a certain orientation as it rotates relative to the pipe 225. This increases the flow of water to that part of the spray arm 224 relative to the other part of the spray arm 224. In some examples, the barrier 258 projects substantially upwardly from an end face of the pipe 225. In some examples, the barrier 258 projects vertically from the end face of the pipe 225. In some examples the barrier 258 may has a semi-circular shape. In some examples a radius of curvature of the barrier 258 is the same as a radius of curvature of the pipe 225. In some examples, the barrier 258 is in a fixed position relative to the pipe 225.

In some examples, the pump 254 is a centrifugal pump. The power consumed by the pump 254 is dependent on the volume of water moved by the pump 254, through the pipe 225, to the spray arm 224 and out of the spray holes 256. As mentioned above, according to examples, the barrier 258 at least partially impedes the flow of water from the pump 254 to a part of the spray arm 224 when the spray arm 224 is in certain orientations. Therefore, the flow of water from the pump 254 to the spray arm 224 varies depending on the orientation of the spray arm 224 relative to the pipe 225. As a result, the power consumed by the pump 254 varies depending on the orientation of the spray arm 224 relative to the pipe 225.

The flow of water from the pump 254, through the pipe 225 and into the spray arm 224 is represented by the dashed arrows.

A controller 234 is provided. The controller 234, which may be a processor or microprocessor or the like, is configured to monitor the power consumption of the pump 254. Monitoring the power consumption of the pump 254 allows for rotational information about the spray arm 224 to be determined. This is because, in normal operation when the spray arm 224 is continually rotating as intended, the power consumed by the pump will conform to a particular profile because of the cyclical water flow resistance provided by the barrier 258. If the power consumption deviates from this profile by more than a predetermined value then the controller 234 determines that the spray arm 224 is not rotating as intended (e.g. the spray arm 224 may have become stuck against an item to be washed 214). The predetermined value may be a fixed power consumption (e.g. +/−1 W), or it may be a percentage of the power consumption (e.g. +/−5%). As a consequence, the controller 234 may cause an alert to be output to a user by, for example, displaying an error message on a display, and/or outputting a warning sound through a speaker. In one example, the controller 234 may deactivate the dishwashing machine if it determines that the spray arm 224 is not rotating as expected.

As shown, the spray arm 224 has a first side 260 and a second side 262. In the example shown in FIGS. 2 and 3, the first side 260 of the spray arm 224 has the same number of spray holes 256 as the second side 262 of the spray arm 224. That is in FIGS. 2 and 3 each side of the spray arm 224 comprises five spray holes 256. In the example shown in FIGS. 4 to 10, the first side 260 of the spray arm 224 has more spray holes 256 than the second side 262 of the spray arm 224. In the example of FIGS. 4 to 10 the first side 260 has five spray holes and the second side 262 has three spray holes.

Figure 2:
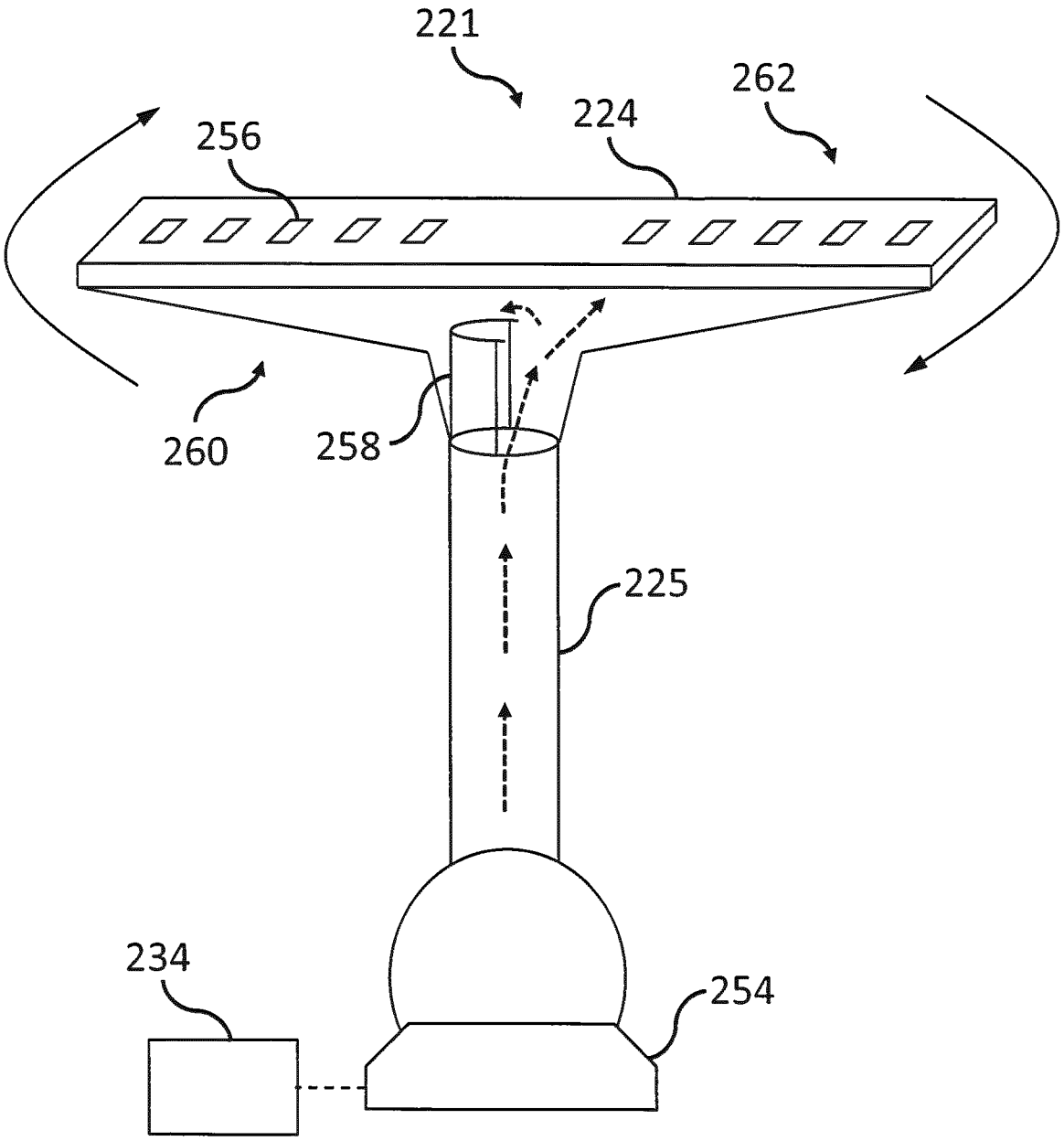
FIG. 2 shows schematically a view of a spray arm assembly according to a first example, with the spray arm in a first orientation.

FIG. 2 shows the spray arm 224 in a first orientation relative to the pipe 225, is the pipe 225 being fixed in position. In this first orientation, the barrier 258 restricts the flow of water from the pump 254 to the spray holes 256 of the first side 260 of the spray arm 224. Therefore, the amount of power consumed by the pump 254 is relatively low because the volume of water conveyed by the pump 254 is relatively low due to the flow restriction provided by the barrier 258.

Figure 3:
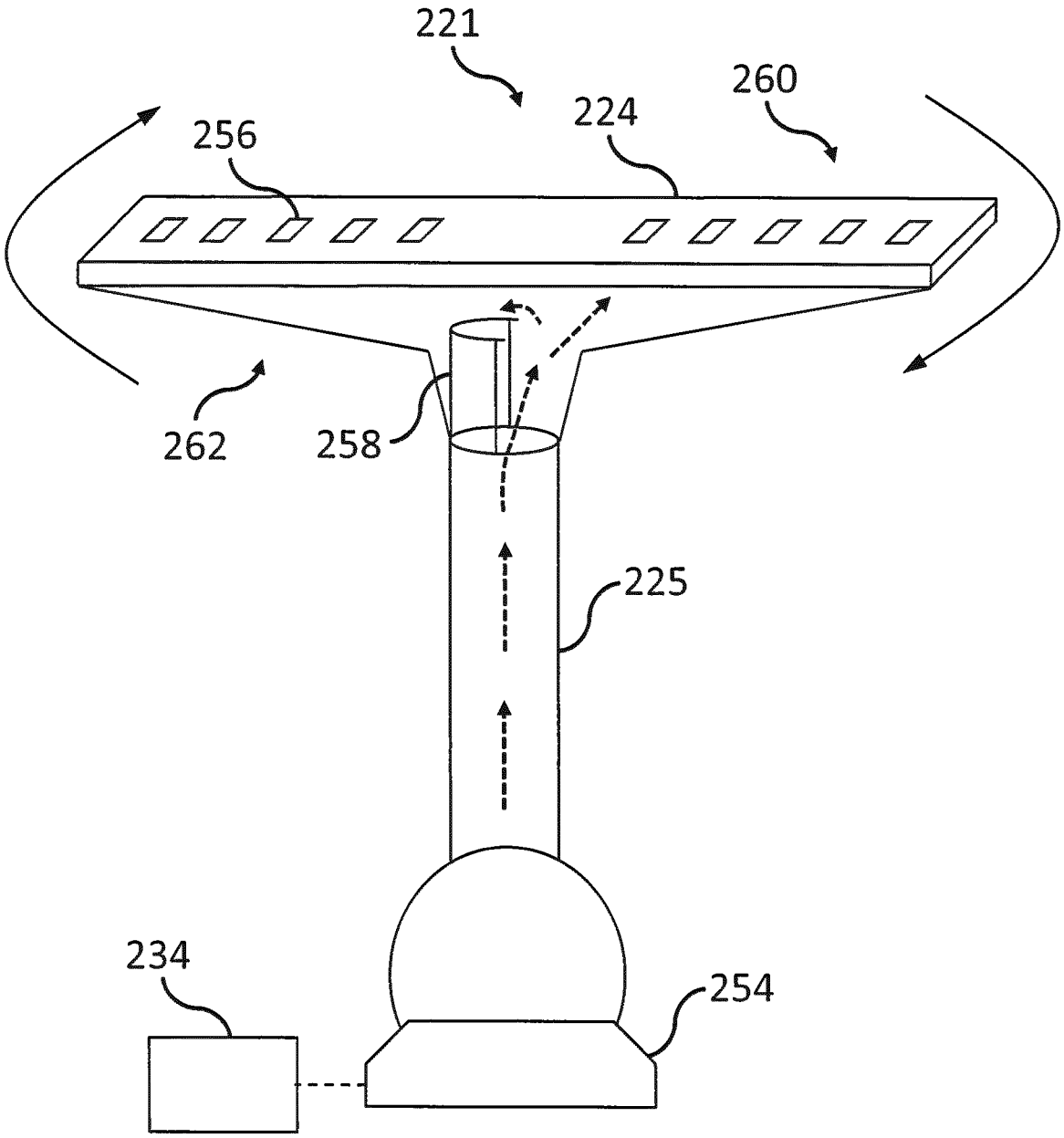
FIG. 3 shows schematically a view of a spray arm assembly according to a first example, with the spray arm in a second orientation.

FIG. 3 shows the spray arm 224 in a second orientation relative to the pipe 225. In FIG. 3 the spray arm 224 has rotated 180 degrees relative to FIG. 2. In this second orientation, the barrier 258 restricts the flow of water from the pump 254 to the spray holes 256 of the second side 262 of the spray arm 224. As with the orientation shown in FIG. 2, the amount of power consumed by the pump 254 is relatively low because the volume of water conveyed by the pump 254 is relatively low due to the flow restriction provided by the barrier 258.

When the spray arm 224 is in an orientation between the first orientation shown in FIG. 2 and the second orientation shown in FIG. 3, the volume of water conveyed by the pump 254 and ejected by the spray holes increases because the barrier 258 becomes less of a restriction and water can more easily flow to both sides 260, 262 of the spray arm 224. This will be explained in more detail below.

Thus where mention is made above to the power consumption of the pump being relatively low (e.g. when in the positions of FIGS. 2 and 3), this may be considered as relatively low compared to when the spray arm 224 is not aligned with the barrier 258 (e.g. when the spray arm 224 is not in the positions of FIGS. 2 and 3).

The cyclical nature of the change in the volume of water output through the spray holes 256 as the spray arm 224 rotates results in a cyclical power consumption profile for the pump 254 (mentioned above). The controller 234 can monitor the power consumed by the pump 254 and can cause an alert to be output to the user if the power consumption is not as expected, which may indicate that the spray arm 224 has got stuck and has stopped rotating, or its rotation is impeded.

Figure 4:
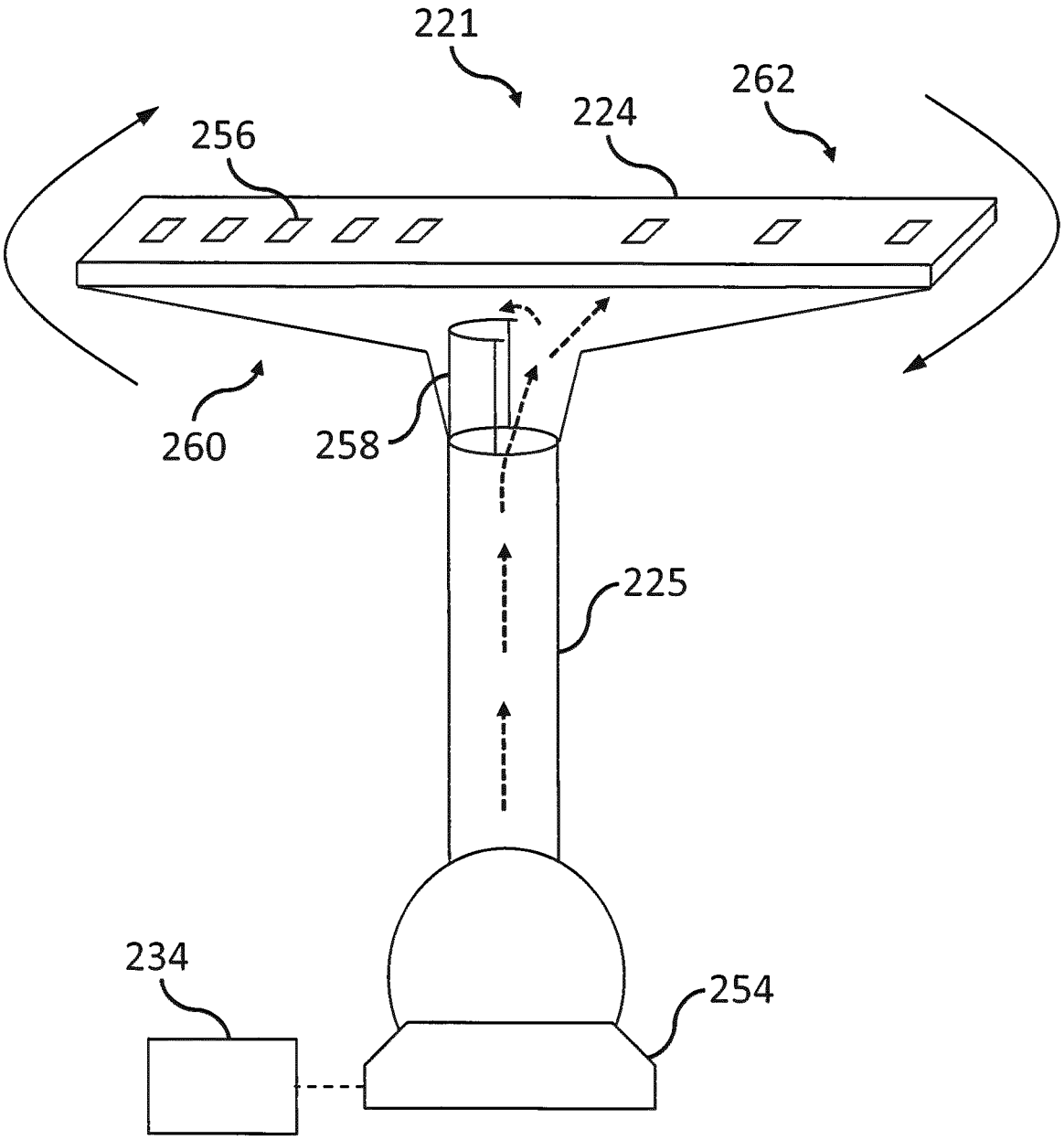
FIG. 4 shows schematically a view of a spray arm assembly according to a second example, with the spray arm in a first orientation.
Figure 5:
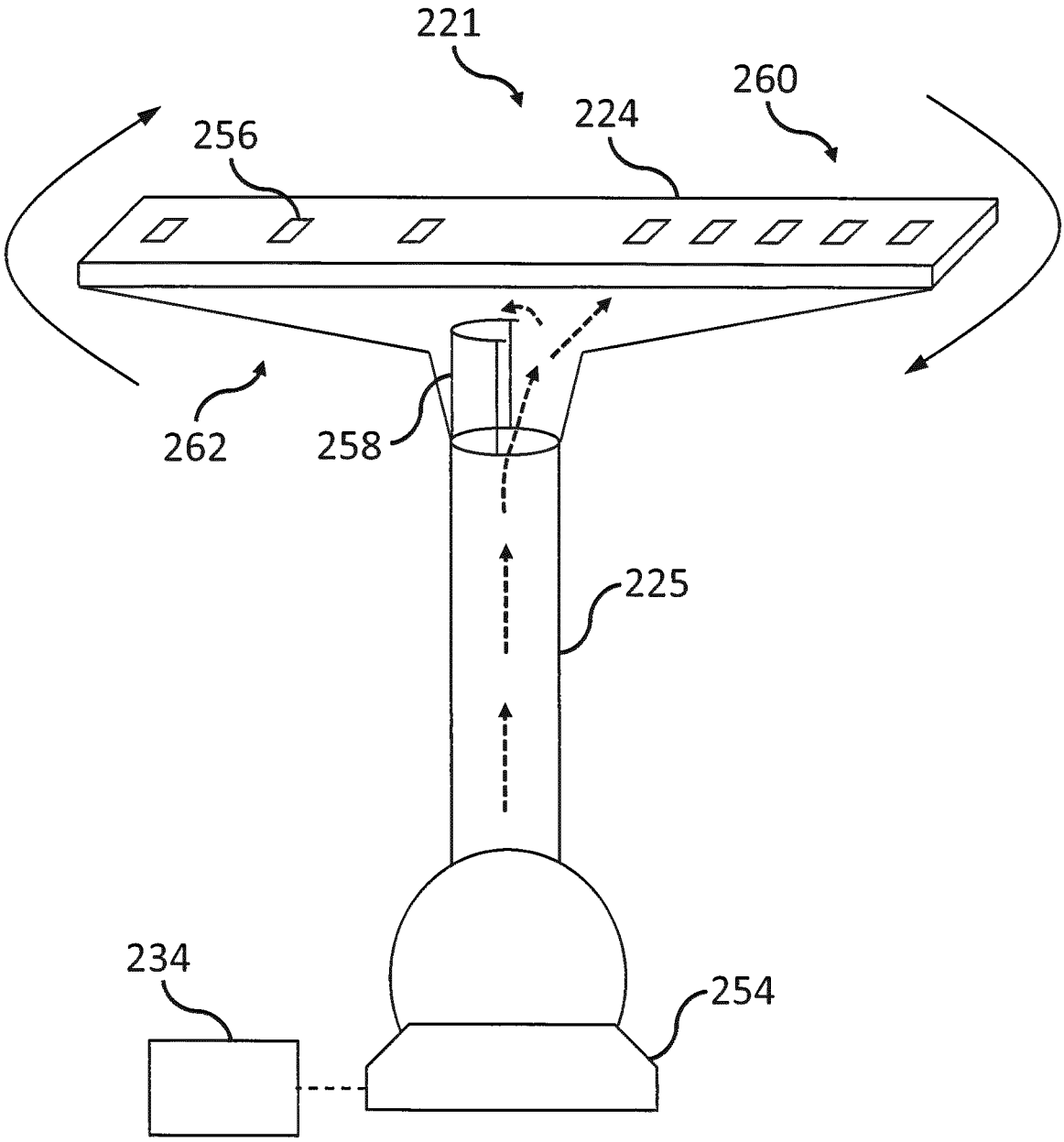
FIG. 5 shows schematically a view of a spray arm assembly according to a second example, with the spray arm in a second orientation.

In the example shown in FIGS. 4 and 5, the second side 262 of the spray arm 224 has fewer spray holes 256 than the first side 260 of the spray arm 224. This construction of the spray arm 224 further restricts the output of water that can be conveyed through the second side 262 of the spray arm 224. This may help provide a more recognisable pump power consumption profile.

The operation of the spray arm 224 and the controller 234 will now be described in more detail with respect to the partial cross section plan views shown in FIGS. 6 to 9. FIGS. 6 to 9 show the spray arm 224 as it rotates in a clockwise direction during use of the dishwashing machine in which it is installed.

Figure 6:
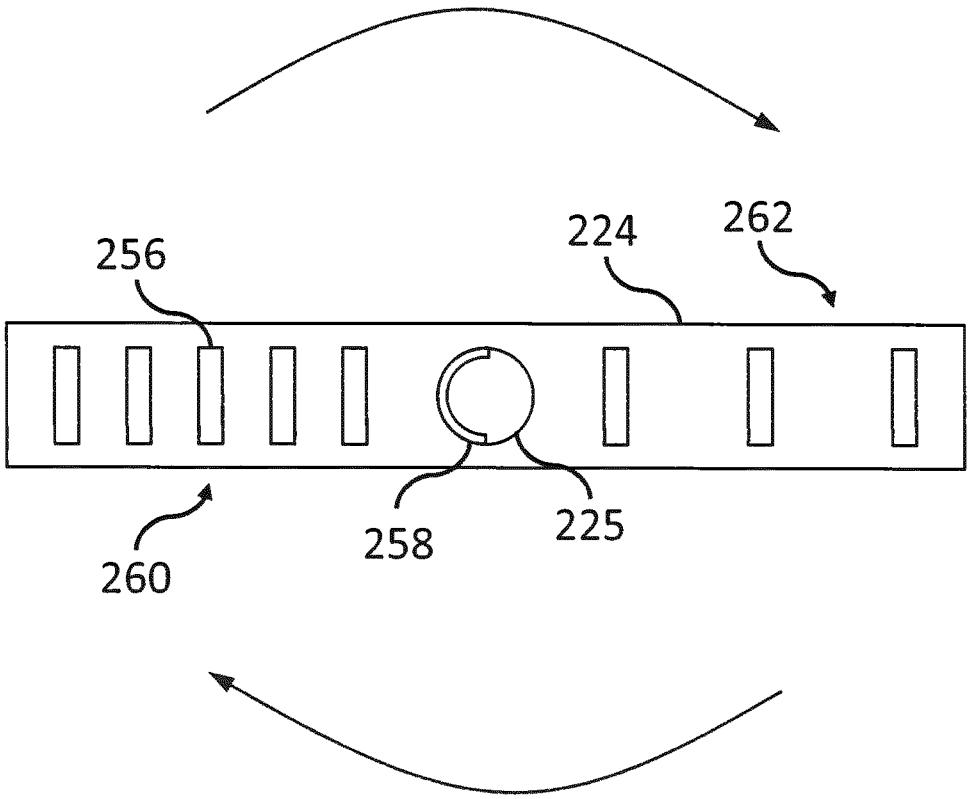
FIG. 6 shows schematically a plan view of a spray arm assembly according to a second example, with the spray arm in a first orientation.

FIG. 6 shows the spray arm 224 in its first orientation as shown in FIG. 4. In this position, the volume of water ejected from the first side 260 of the spray arm 224 is $V_1$ and the volume of water ejected from the second side 262 of the spray arm 224 is $V_2$. $V_1$ is approximately the same as $V_2$ due to the effect of the barrier 258 impeding water flow to the first side 260 of the spray arm 224 being mitigated by there being fewer spray holes 256 in the second side 262 of the spray arm 224. In this orientation the power consumed by the water pump 254 in ejecting the water may be considered $P_{12}$.

Figure 7:
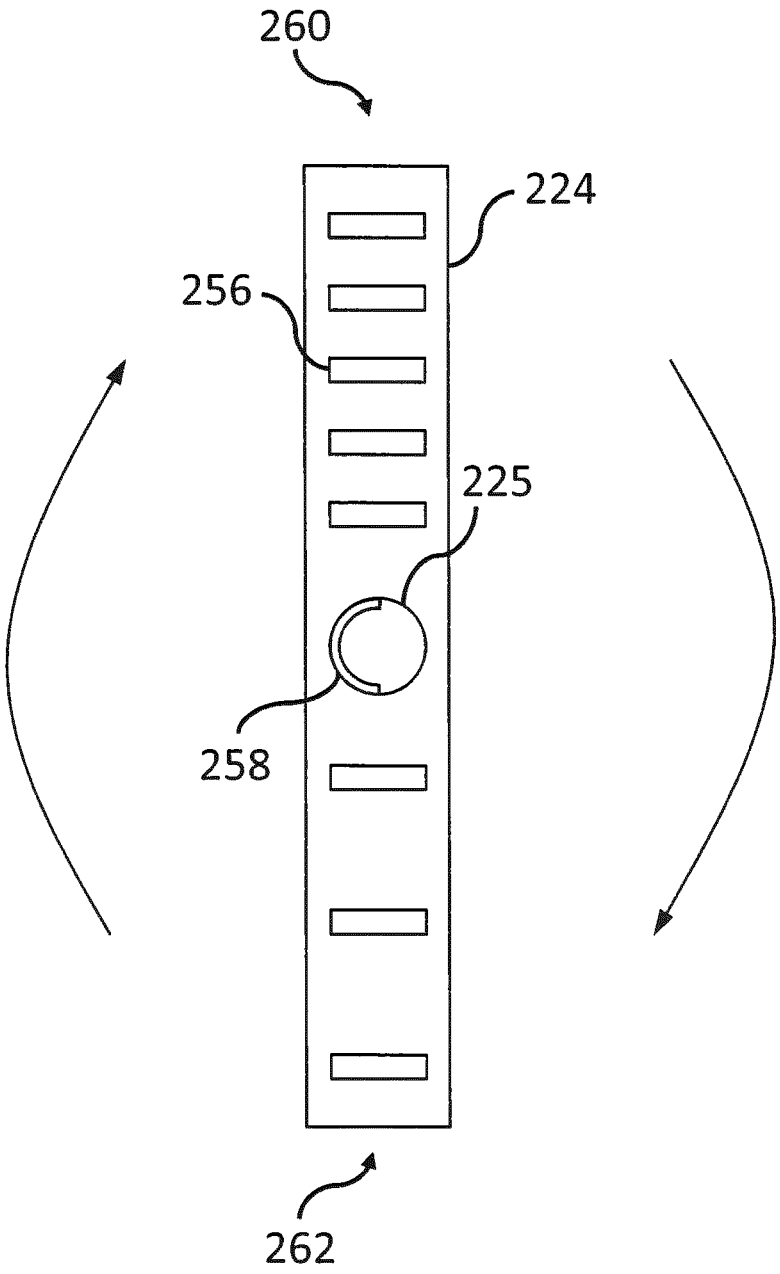
FIG. 7 shows schematically a plan view of a spray arm assembly according to a second example, with the spray arm in transition between a first orientation and a second orientation.

FIG. 7 shows the spray arm 224 in between rotating from its first orientation to its second orientation. In this position, the volume of water ejected from the first side 260 of the spray arm 224 is $V_3$ and the volume of water ejected from the second side 262 of the spray arm 224 is $V_4$. $V_3$ is larger than $V_4$ due to there being more spray holes 256 in the first side 260 of the spray arm 224. In this orientation the power consumed by the water pump 254 in ejecting the water may be considered $P_{34}$.

Figure 8:
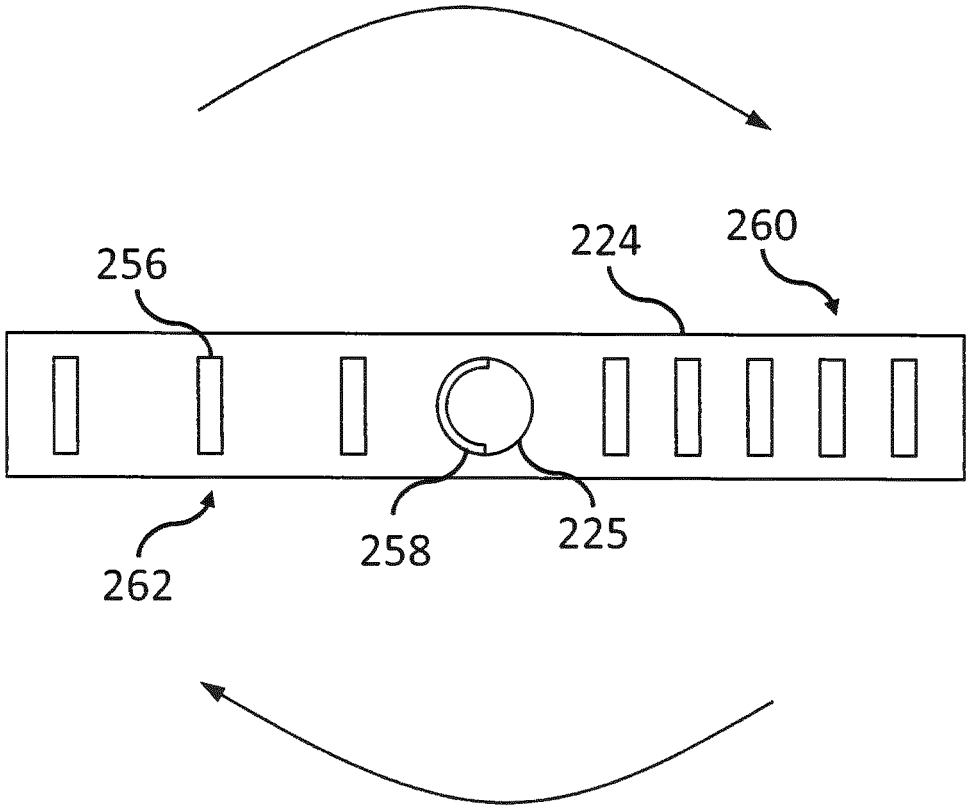
FIG. 8 shows schematically a plan view of a spray arm assembly according to a second example, with the spray arm in a second orientation.

FIG. 8 shows the spray arm 224 in its second orientation as shown in FIG. 5. In this position, the volume of water ejected from the first side 260 of the spray arm 224 is $V_5$ and the volume of water ejected from the second side 262 of the spray arm 224 is $V_6$. $V_5$ is larger than $V_6$ due to the barrier 258 impeding water flow to the second side 262 of the spray arm 224, and due to there being more spray holes 256 in the first side 260 of the spray arm 224. In this orientation the power consumed by the water pump 254 in ejecting the water may be considered $P_{56}$. $P_{56}$ is higher than $P_{12}$ because in the orientation of FIG. 8 the barrier 258 only restricts water flow to the second side 262 of the spray arm 224, which has fewer holes than the first side 260 of the spray arm 224. However, in the orientation of FIG. 5, the barrier 258 impedes water flow to the first side 260 of the spray arm 224.

Figure 9:
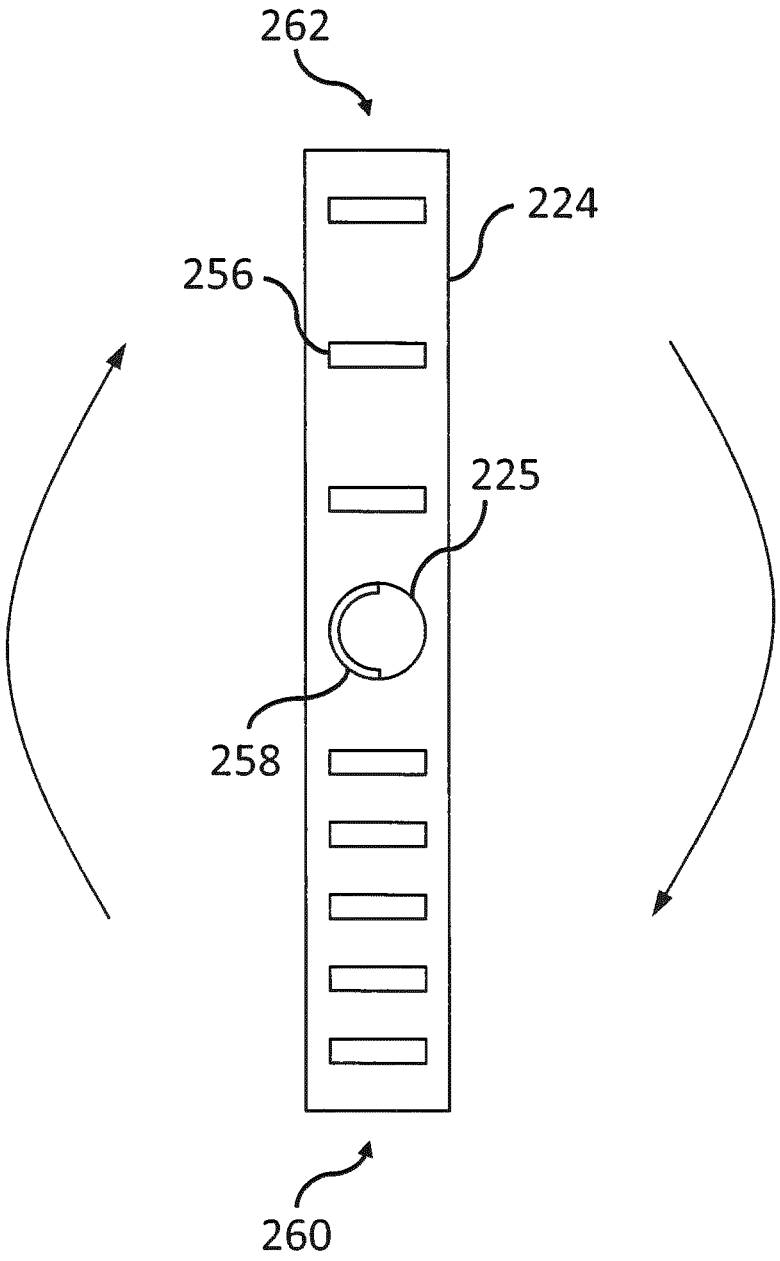
FIG. 9 shows schematically a plan view of a spray arm assembly according to a second example, with the spray arm in transition between a second orientation and a first orientation.

FIG. 9 shows the spray arm 224 in between rotating from its second orientation to its first orientation. In this position, the volume of water ejected from the first side 260 of the spray arm 224 is $V_7$ and the volume of water ejected from the second side 262 of the spray arm 224 is $V_8$. $V_7$ is larger than $V_8$ due to there being more spray holes 256 in the first side 260 of the spray arm 224. In this orientation the power consumed by the water pump 254 in ejecting the water may be considered $P_{78}$. $P_{78}$ is approximately the same as $P_{34}$ because in the positions of the spray arm 224 in FIGS. 7 and 9 the barrier 258 equally restricts water flow to each side 260, 262 of the spray arm 224.

Since the volume of water ejected out of the spray arm 224 varies as the spray arm 224 rotates over time, the power consumed by the water pump 254 also varies as the spray arm 224 rotates over time. As such, the power consumption of the pump 254 can be predicted over time.

Figure 10:
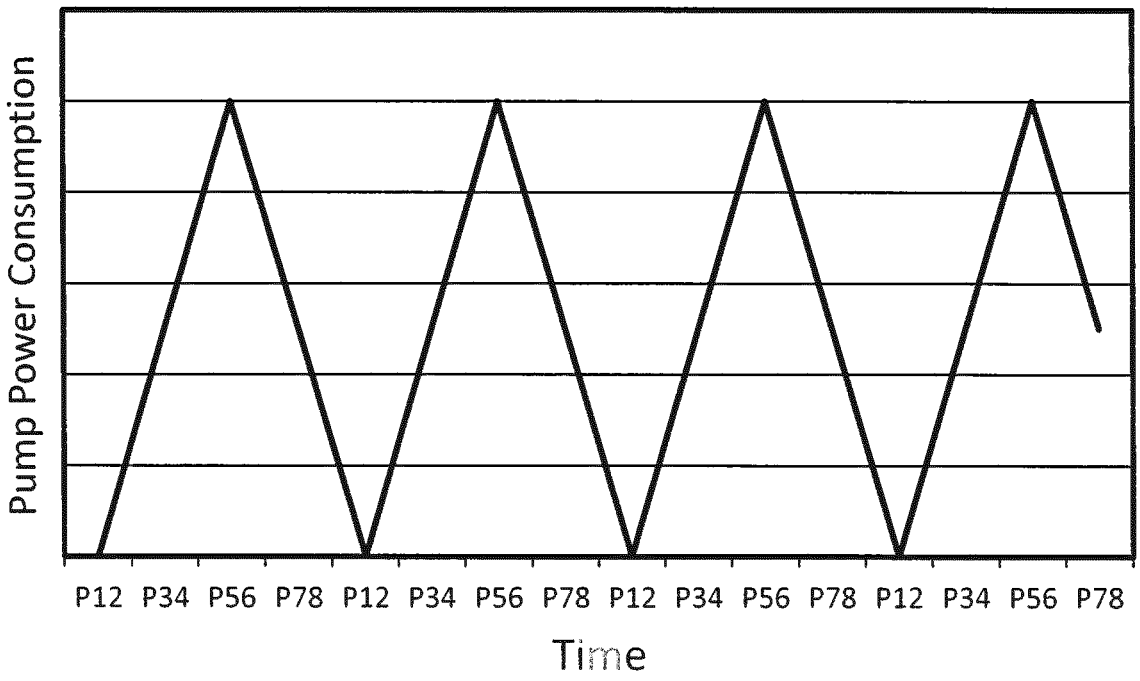
FIG. 10 shows schematically a plot of power consumption of a pump against time, according to an example.

FIG. 10 shows an example of pump power consumption fluctuating over time as the spray arm 224 rotates, between a minimum power consumption when the spray arm 224 is in the position shown in FIG. 6 and a maximum power consumption when the spray arm is in the position shown in FIG. 8. The dishwashing machine 200 may include a data storage for storing information related to the expected power consumption of the pump 254. For example, the data storage may store expected power consumption information, for example as represented by the graph show in FIG. 10.

According to examples the controller 234 is configured to monitor the power that is consumed by the pump 254 as the spray arm 224 rotates. In some examples, the controller 234 is configured to cause an alarm to be output to a user if the power consumption deviates from the expected profile shown in FIG. 10 by more than a predetermined or threshold value (e.g. by more than 5%). The alarm may be a signal to a speaker to output an alert or buzzer sound. In another example, the alarm may be a visual alert output to a display. The alarm may alert or prompt the user to fix the fault e.g. to move the item that is blocking the spray arm 224. If the power consumption deviates from the expected profile by less than a predetermined value then in some examples the controller 234 takes no action, but continues to monitor the power consumed by the pump 254. This allows for minor variations in power consumption of the pump to be accounted for, which may not be a result of the spray arm 224 getting stuck on an item to be washed.

In another example, the controller 234 is configured to cause an alarm to be output if the power consumption deviates from the expected profile shown in FIG. 10 for more than a predetermined time period (e.g. ten seconds).

In some examples, when the determined power consumption of the pump 254 differs from the expected rate by more than a predetermined threshold value or for more than a predetermined period of time, the controller 234 is configured to halt the washing cycle. Halting the washing cycle may include halting power and/or water to the spray arm(s). In some examples the washing cycle is only resumed after the door of the washing machine has been opened and closed (i.e. indicative that a user has cleared the obstruction), and/or after a certain user input on the user interface 136 (e.g. pressing an "OK" button), and/or after one or more test rotations of the spray arm(s). In some examples the washing cycle may be automatically restarted after it has been determined that an alert state (e.g.) blockage of spray arm, has been cleared.

The above example allows for the controller 234 to accurately estimate when the spray arm 224 has been blocked by an obstruction in the dishwashing machine 200, such as caused by an incorrectly placed item to be washed. The controller 234 can then alert the user so that the user can remove the obstruction. This helps to prevent damage to the spray arm 224 and the water pump 254, and it also ensures that the cleaning quality of a washing cycle is not compromised by the spray arm 224 being unable to rotate.

Reference is made herein to data storage for storing data, such as memory. This may be provided by a single device or by plural devices. Suitable devices include for example a hard disk and non-volatile semiconductor memory.

The examples described herein are to be understood as illustrative examples of embodiments of the invention. Further embodiments and examples are envisaged. Any feature described in relation to any one example or embodiment may be used alone or in combination with other features. In addition, any feature described in relation to any one example or embodiment may also be used in combination with one or more features of any other of the examples or embodiments, or any combination of any other of the examples or embodiments. Furthermore, equivalents and modifications not described herein may also be employed within the scope of the invention, which is defined in the claims.

The invention claimed is:

1. A dishwashing machine comprising:

a controller;

a spray arm assembly comprising a rotatable spray arm having one or more spray holes for spraying a washing load with water, and a pipe for delivering water to the spray arm, wherein the pipe comprises a barrier for at least partially restricting a flow of water to the spray arm, wherein the barrier projects vertically from an end face of the pipe, and wherein the barrier is semi-circular in plan-view and has a radius of curvature equal to a radius of curvature of the pipe;

a pump for pumping water through the pipe and to the spray arm;

the pipe and its barrier being constructed and arranged to at least partially restrict flow of water from the pump to at least a part of the spray arm dependent on spray arm orientation relative to the pipe, a power consumption of the pump thereby being dependent at least in part on the spray arm orientation relative to the pipe and its barrier; and the controller being configured to monitor the power consumption of the pump in order to determine rotational information of the spray arm, and wherein the controller is configured to monitor rotation of the spray arm by monitoring said power consumption of the pump while the pump operates to pump water.

2. A dishwashing machine according to claim 1, wherein the barrier is integrally formed with the pipe.

3. A dishwashing machine according to claim 1, wherein the one or more spray holes are oriented so as to facilitate rotation of the spray arm when water is ejected from the one or more spray holes.

4. A dishwashing machine according to claim 1, wherein the spray arm comprises a first side and a second side, and wherein the first side of the spray arm has more spray holes than the second side of the spray arm.

5. A dishwashing machine according to claim 1, wherein the controller is configured to determine the rotational information of the spray arm by comparing a determined power consumption of the pump with an expected power consumption of the pump.

6. A dishwashing machine according to claim 5, wherein the controller is configured to cause an alert to be output to a user when the determined power consumption of the pump differs from the expected power consumption of the pump by more than a predetermined value.

7. A dishwashing machine according to claim 5, wherein the controller is configured to cause an alert to be output to a user when the determined power consumption of the pump differs from the expected power consumption of the pump for longer than a predetermined time period.

8. A method comprising:

monitoring a power consumption of the pump of the dishwashing machine recited in claim 1 using the controller of the dishwashing machine, wherein the controller monitors the power consumption of the pump in order to determine the rotational information of the spray arm, and wherein the controller monitors the rotation of the spray arm by monitoring said power consumption of the pump while the pump operates to pump water.

9. A method according to claim 8, comprising determining rotational information of the spray arm by comparing a determined power consumption of the pump with an expected power consumption of the pump.

10. A method according to claim 9, comprising causing an alert to be output to a user when the determined power consumption of the pump differs from the expected power consumption of the pump by more than a predetermined value.

11. A method according to claim 9, comprising causing an alert to be output to a user when the determined power consumption of the pump differs from the expected power consumption of the pump for longer than a predetermined time period.

12. A method according to claim 9, comprising halting a washing cycle of the dishwashing machine when the determined power consumption of the pump differs from the expected power consumption of the pump.

13. The method according to claim 12, comprising automatically restarting the washing cycle when it is determined that an alert has been cleared.

* * * * *